US005507240A

United States Patent [19]

Goldbeck et al.

[11] Patent Number: 5,507,240

[45] Date of Patent: Apr. 16, 1996

[54] FOLDING STAMP FOR A SEWING MACHINE

[75] Inventors: Heinz Goldbeck, Bielefeld; Werner Meyer, Enger; Herbert Struck, Lohne, all of Germany

[73] Assignee: Dürkopp Adler Aktiengesellschaft, Germany

[21] Appl. No.: 339,509

[22] Filed: Nov. 14, 1994

Related U.S. Application Data

[63] Continuation of Ser. No. 92,502, Jul. 15, 1993, abandoned.

[30] Foreign Application Priority Data

Jul. 17, 1992 [DE] Germany ..... 42 23 527.8

[51] Int. Cl.[6] ..... D05B 21/00

[52] U.S. Cl. ..... 112/470.16; 112/147; 112/311

[58] Field of Search ..... 112/147, 68, 121.12, 112/121.15, 311, 470.16; 223/37, 38

[56] References Cited

U.S. PATENT DOCUMENTS 4,034,689 7/1977 Hintzen et al. ..... 112/68

4,481,895 11/1984 Asao et al. .

5,092,258 3/1992 Goldbeck et al. .

*Primary Examiner*—Paul C. Lewis

*Attorney, Agent, or Firm*—Ostrolenk, Faber, Gerb & Soffen

[57] ABSTRACT

A folding stamp for folding sewing parts which are to be attached to a main sewing part, in a sewing system for making pockets in articles of clothing. The additional sewing parts, such as flaps or pocket-bag blanks, can be fed manually. This folding stamp has a fastening unit arranged on an upwardly and rearwardly extending extension formed on a vertical web. The fastening unit thereby extends above a resting surface on top of the web and in the direction toward the rear end of the folding stamp. The folding stamp is thereby arcuate or C-shaped in longitudinal cross-section, which gives it a compact construction and gives the operator an unimpeded view of the region in which he must feed the additional sewing parts.

18 Claims, 3 Drawing Sheets

FOLDING STAMP FOR A SEWING MACHINE

This is a continuation of application Ser. No. 08/092,502 filed on Jul. 15, 1993, now abandoned.

FIELD OF THE INVENTION

The present invention relates to a folding stamp for folding sewing parts which are to be attached to a main sewing part, in an automatic sewing machine for making pockets in articles of clothing.

BACKGROUND ART

A known folding stamp has a web extending in a longitudinal direction, a base plate fastened to the web, and a plate on the web forming a resting surface. A fastening unit connects the folding stamp to other equipment in the sewing system. Guide plates are arranged on both sides of the web at its front end for guiding workpieces into the folding stamp.

In the DÜRKOPP Class 746 sewing system which is used for the production of piped pockets, a gripping/folding stamp is used, by which a strip of piping is automatically placed on the main part of the material being sewn, in an application station associated with the sewing machine, and the piping strip can be folded around the gripping/folding stamp. The attachment parts such as flaps, trimming and pocket-bag blanks are applied by hand to the gripping/folding stamp. In order to simplify this operation for the operator, this gripping/folding stamp is provided with a so-called resting surface which is formed by a plate which closes off the top of the web and widens it.

Since this gripping/folding stamp has to carry out a swinging motion (in order to grip and feed the strip of piping) and a vertical motion (in order to position the strip of piping) it is connected to the sewing machine via a fastening unit which is fastened to its web approximately at the center along its length. The resting surface is arranged behind the fastening unit as seen from the direction of the sewing station. The resting surface formed on the gripping/folding stamp must be sufficiently long for the work pieces which are to be placed on it to be suitably aligned. The gripping/folding stamp of the prior art is therefore relatively long.

The transport path of the workpieces to be sewn together, from the feed station into the sewing station, depends on the length of the gripping/folding stamp. The longer this path, the greater the corresponding cycle time of the sewing machine.

Federal Republic of Germany 38 34 434 C2 (corresponding to U.S. Pat. No. 5,092,258) (Goldbeck et al.) discloses a gripping/folding stamp which is used in a sewing system in which the strip of piping and the flap and/or the pocket-bag blank are automatically fed. Since the feeding and folding involve purely automatic movements and can be reproduced at any time, the gripping/folding stamp can be made correspondingly short in order to decrease the cycle time. That is, the aligning of the workpieces is effected on the feed tables, and not on the gripping/folding stamp itself. For this reason, the gripping/folding stamp can be of relatively simple construction. Since it does not have a resting surface which widens the web, manual feeding of the flap and/or the pocket-bag blank is not possible, except in a very time-consuming manner, if at all.

SUMMARY OF THE INVENTION

The main object of the invention is therefore to develop a folding stamp which is suitable for the manual feeding of workpieces, is extremely compact in its construction, can be manufactured economically, and can be attached to sewing machines already in use.

This object can be achieved, according to an aspect of the invention, by arranging the fastening unit on an upward-extending extension of the folding stamp. The extension is formed on the web and extends above the resting surface in the direction toward the rear end of the folding stamp. This structure gives the folding stamp a generally arcuate or C-shaped longitudinal vertical cross-sectional shape.

According to another aspect of the invention, additional advantages may be obtained by forming the resting surface of two plate halves which are arranged at a distance apart on the web. Preferably, the two plate halves are covered and secured to the web by another single-piece plate.

Because the fastening unit extends above the resting surface, and a free space is formed between the fastening unit and the resting surface by the arcuate overhang, the folding stamp can be shorter, by at least the length of the fastening unit, than the prior art folding stamp.

BRIEF DESCRIPTION OF THE DRAWINGS

Other objects, features and aspects of the invention will be understood from the following detailed description of an embodiment thereof, with reference to the drawings, in which.

DETAILED DESCRIPTION OF THE DISCLOSED EMBODIMENT

Figure 1:
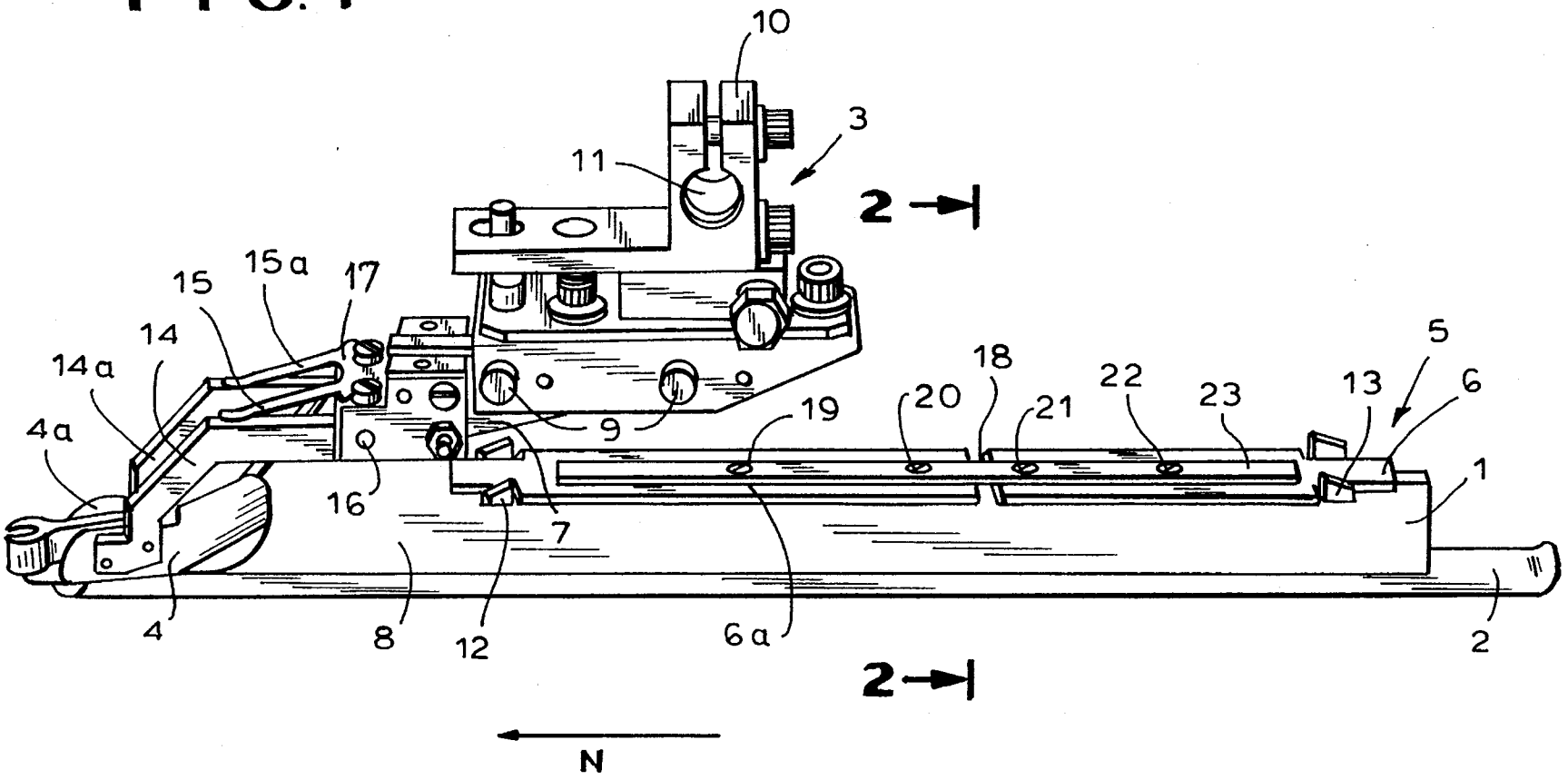
FIG. 1 is a perspective view of the folding stamp according to an embodiment of the invention.

As seen in FIG. 1, the folding stamp has a web 1, a base plate 2 which is fastened to it, and plates 6, **6*a* which are fastened on top of the web 1 and, together with the web 1, form a resting surface 5. There is also a fastening unit 3 which is arranged on an extension 7. Without impairing the operability of the folding stamp, a single continuous plate could also be provided instead of the two plates 6, 6*a***.

On the front end of the folding stamp, guide plates 4, **4*a* are arranged on either side of the web 1 in order to guide the workpieces which are to be sewn together (not shown in detail here). The guide plates 4, 4*a* are fastened to arms 14, 14*a* which are swingably connected by a bolt 16 to the web 1. Above the arms 14, 14*a*, a spring plate 17 having two extensions 15, 15*a* is screwed to the web 1. The extensions 15, 15*a* press the arms 14, 14*a* downward to such an extent that a narrow gap remains between the base plate 2 and the guide plates 4, 4*a*, which gap can possibly be enlarged by thicker material to be sewn which lifts the guide plates 4, 4*a***.

The web 1 has a height of about 25 mm. In the region of the guide plates 4, **4*a*—at a higher part 8 of the web 1—the height of the web 1 suddenly increases. The transition of the web 1** at that place to a different height can take place either at a right angle or with a radius, that is, in arcuate fashion.

Figure 3:
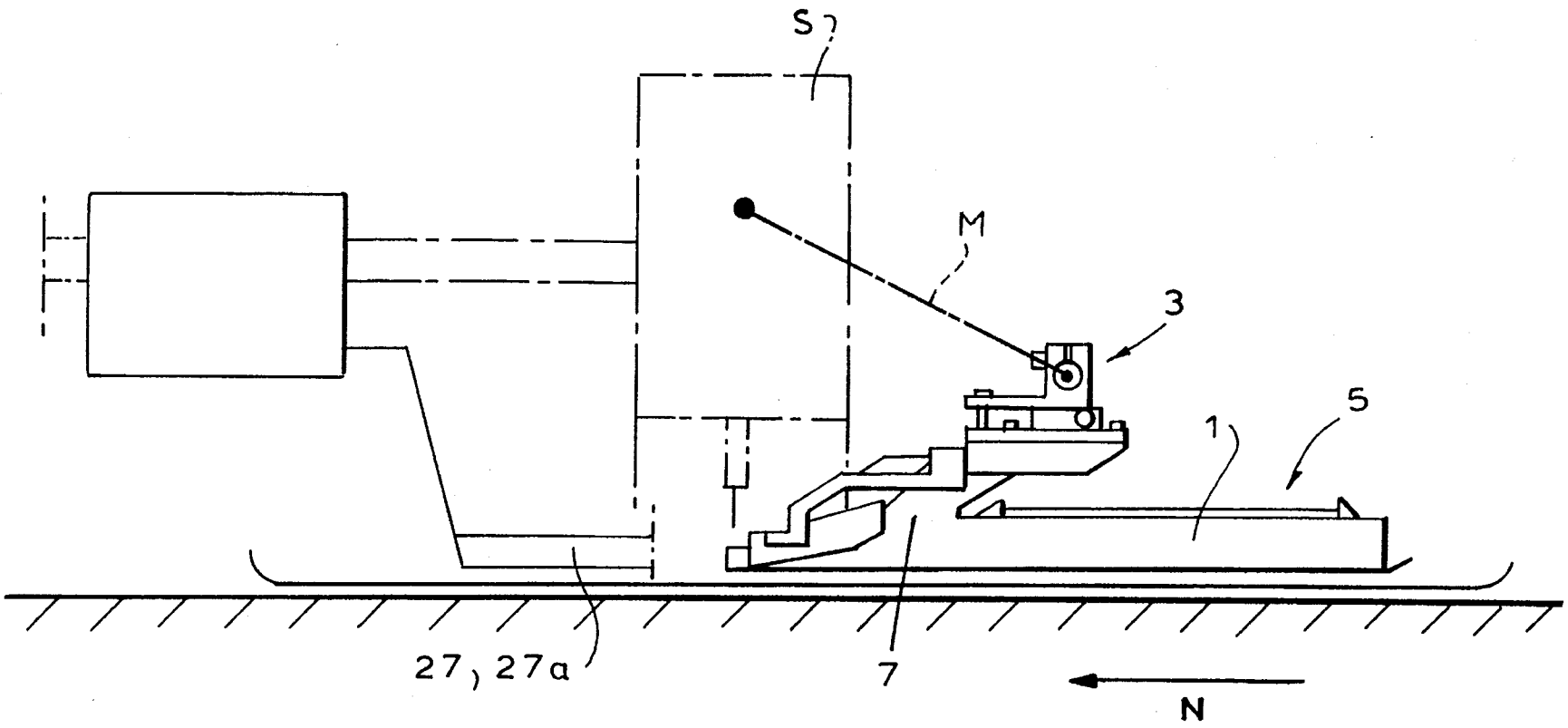
FIG. 3 is an elevational view of the folding stamp of FIG. 1, in combination with a conventional automatic sewing machine.

The extension 7 is spaced at a vertical distance from the plates 6, 6*a*, at an upper part of the higher part 8 of the web 1. The extension 7 extends in the direction toward the rear end of the folding stamp (opposite the direction N, which is the direction toward the sewing machine S as shown in FIG. 3). The extension 7 extends above the resting surface 5. The side view of the folding stamp as seen in FIG. 1 and FIG. 3 accordingly is generally C-shaped in its longitudinal vertical cross-sectional shape. In order to increase the free space above the resting surface 5, the lower edge of the extension 7 which faces the resting surface 5 is angled obliquely upward. The upper edge of the extension 7 extends parallel (in this non-limiting example) to the resting surface 5 to create a parallel resting surface for the fastening unit 3, the fastening unit being fastened for instance by screws 9 to the extension 7.

The fastening unit 3 is provided with a known clamp 10 for clamping the fastening unit within the feed station of the sewing system. As is known, the fastening unit 3 is mounted by a support means M, shown schematically in FIG. 3, to the sewing machine S.

Figure 2:
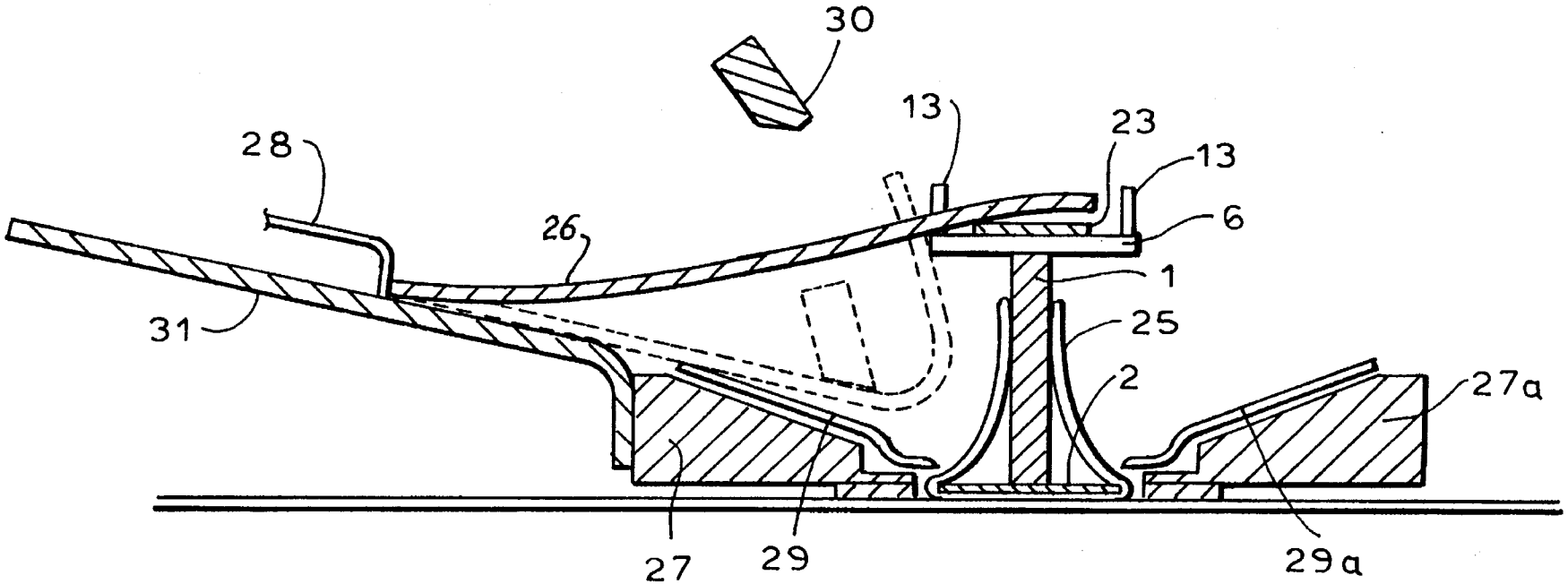
FIG. 2 is a simplified sectional view of the feed station of the folding stamp, taken along the line 2—2 of FIG. 1; and 7.

Referring now to FIG. 2, the base plate 2 is made of a thin spring plate material and is substantially wider than the web 1 in order to facilitate the folding of the piping strip 25 around the base plate 2 and the web 1. The part of the web 1 that supports the resting surface 5 has a selected height such that the folded piping strip 25 can rest without interference between the upper plate halves 6, 6*a* and the lower plate 2. In order to obtain a continuous resting surface for the workpieces to be applied, a single-piece plate 23 is fastened to the tops of the two plate halves 6, 6*a*.

The extension 7 which is formed on the higher part 8 at the front end of the web 1 extends at an angle of approximately 20 degrees upward in the direction toward the rear end of the folding stamp, the extension 7 and the web 1 being aligned in a vertical plane. The extension 7 extends back so far that the articulation point 11 which is provided in the clamp 10, by means of which the folding stamp is fastened to the sewing system (feeding station), lies approximately in the last third of the front half of the folding stamp. The distance maintained between the resting surface 5 and the fastening unit 3 or extension 7 must be selected to be sufficiently large to be able to feed a workpiece (flap, pocket-bag blank) without interference in the direction 14, from the rear end of the folding stamp, and for the operator to have an unimpeded view of the resting table 5. Of course, the fastening unit 3 could also be fastened directly to the higher part 8 of the web 1 if, instead of the extension 7 on the web 1, an extension providing the corresponding function were provided on the fastening unit 3. It is essential merely that there be enough space between the fastening unit 3 and the resting surface 5 to assure a free view for the operator.

Stops 12, 13 can be located on the upper plate halves 6, 6*a* of the resting table 5, for aligning the workpiece to be fed (such as a flap, or pocket-bag blank).

As shown in FIG. 1, it is particularly simple to adjust the stops with respect to the sewing system or each other, in that the two plate halves 6, 6*a* are arranged at an adjustable distance from each other. Both plate halves 6, 6*a* have elongated holes for attaching them onto the web 1 (in a manner not shown in detail) so that the relative position of the plate halves 6, 6*a* with respect to the fastening screws 19, 20, 21, 22 and the width of the slot 18 can be adjusted within the limits established by the length of the elongated holes.

FIG. 2 shows a piping strip 25 being folded around the web 1 by means of folding plates 29, 29*a*. The flap 26 is aligned laterally against the stop 28 provided on the feed plate 31 and longitudinally against the stops 12, 13 (only the stops 13 being shown). The flap clamp 30 fixes the flap 26, after it is aligned on the resting surface 5, on one of the two clamp halves 27, 27*a* (the clamp half 27 in this example) which form the sewing-material clamp (FIG. 3).

The process of folding, jointly transporting, and sewing together the individual workpieces has been known for a long time and is described, for instance, in Federal Republic of Germany 38 34 434 C2 and in U.S. Pat. No. 4,481,895, so that a more thorough explanation may be dispensed with here.

Instead of automatic feeding, the individual workpieces can be placed manually on the main part of the sewing material and suitably aligned. Then, the folding process and the transport of the sewing material to the sewing place are effected automatically.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A folding stamp for use in an automatic sewing machine for folding attachment parts which are to be attached to a main sewing part, comprising:

a web extending in a longitudinal direction from a front end to a rear end of the folding stamp, a base plate extending along a bottom part of the web, and a resting surface extending along a top part of the web; and a fastening unit for fastening the folding stamp to an automatic sewing machine;

wherein the resting surface is formed by a plate having two plate halves which are arranged spaced apart on the web with an adjustable spacing therebetween.

2. A folding stamp according to claim 1, wherein said two plate halves are secured to the web by a single-piece plate.

3. A folding stamp according to claim 1, further comprising guide plates arranged on both sides of the web at the front end thereof, for guiding workpieces along both sides of the web.

4. A folding stamp according to claim 3, wherein the fastening unit is arranged on an extension which extends upward and rearward from the web, above the resting surface in the direction toward the rear end of the folding stamp, so that the folding stamp, including the web, the extension, and the fastening unit, has a generally C-shaped longitudinal vertical cross-sectional shape.

5. A folding stamp according to claim 4, wherein the extension and the resting surface define a free space located below the extension and above the resting surface, for receiving an attachment part that is to be folded.

6. A folding stamp according to claim 1, wherein the fastening unit is arranged on an extension which extends upward and rearward from the web, above the resting surface in the direction toward the rear end of the folding stamp, so that the folding stamp, including the web, the extension, and the fastening unit, has a generally c-shaped longitudinal vertical cross-sectional shape.

7. A folding stamp according to claim 6, wherein the extension and the resting surface define a free space located below the extension and above the resting surface, for receiving an attachment part that is to be folded.

8. A folding stamp for use in an automatic sewing machine for folding attachment parts which are to be attached to a main sewing part, comprising:

a web extending in a longitudinal direction from a front end to a rear end of the folding stamp, a base plate extending along bottom part of the web, and a resting surface extending along top part of the web; and a fastening unit for fastening the folding stamp to an automatic sewing machine;

the fastening unit being arranged on an extension which extends upward and rearward from the web, above the resting surface in the direction toward the rear end of the folding stamp, so that the folding stamp, including the web, the extension, and the fastening unit, has a generally C-shaped longitudinal vertical cross-sectional shape.

9. A folding stamp according to claim 8, further comprising guide plates arranged on both sides of the web at he front end thereof, for guiding workpieces along both sides of the web.

10. A folding stamp according to claim 8, wherein said resting surface is generally horizontal.

11. A folding stamp according to claim 10, wherein the resting surface is formed by a plate having two plate halves which are arranged spaced apart on the web with an adjustable spacing therebetween.

12. A folding stamp according to claim 11, wherein said two plate halves are secured to the web by a single-piece plate.

13. A folding stamp according to claim 8, wherein the extension and the resting surface define a free space located below the extension and above the resting surface, for receiving an attachment part that is to be folded.

14. An automatic sewing machine including a folding stamp for folding attachment parts which are to be attached to a main sewing part, comprising:

a feeding station; support means in the feeding station for supporting a folding stamp;

a folding stamp supported on the support means; the folding stamp comprising:

a web extending in a longitudinal direction from a front end to a rear end of the folding stamp, a base plate extending along a bottom part of the web, and a resting surface extending along a top part of the web; and a fastening unit for fastening the folding stamp to the support means;

the fastening unit being arranged on an extension which extends upward and rearward from the web, above the resting surface in the direction toward the rear end of the folding stamp, so that the folding stamp, including the web, the extension, and the fastening unit, has a generally C-shaped longitudinal vertical cross-sectional shape.

15. A folding stamp according to claim 14, wherein said resting surface is generally horizontal.

16. A folding stamp according to claim 15, wherein the resting surface is formed by a plate having two plate halves which are arranged spaced apart on the web with an adjustable spacing therebetween.

17. A folding stamp according to claim 16, wherein said two plate halves are secured to the web by a single-piece plate.

18. A folding stamp according to claim 14, wherein the extension and the resting surface define a free space located below the extension and above the resting surface, for receiving an attachment part that is to be folded.

* * * * *